US011006815B2

(12) United States Patent
Kang

(10) Patent No.: US 11,006,815 B2
(45) Date of Patent: May 18, 2021

(54) PORTABLE SHOE SURFACE CLEANING CLOTH

(71) Applicant: Hung-Chuan Kang, Kaohsiung (TW)

(72) Inventor: Hung-Chuan Kang, Kaohsiung (TW)

( * ) Notice: Subject to any disclaimer, the term of this patent is extended or adjusted under 35 U.S.C. 154(b) by 0 days.

(21) Appl. No.: 16/693,402

(22) Filed: Nov. 25, 2019

(65) Prior Publication Data

US 2020/0093349 A1 Mar. 26, 2020

(51) Int. Cl.

| | |
|---|---|
| ***A47L 23/10*** | (2006.01) |
| ***A47L 13/16*** | (2006.01) |
| ***A47L 13/17*** | (2006.01) |
| *D06N 7/00* | (2006.01) |

(52) U.S. Cl.

CPC ..... *A47L 23/10* (2013.01); *A47L 13/16* (2013.01); *A47L 13/17* (2013.01); *D06N 7/0092* (2013.01); *Y10T 428/2481* (2015.01); *Y10T 428/24802* (2015.01)

(58) Field of Classification Search

CPC ..... A47L 13/00; A47L 13/10; A47L 13/16; A47L 13/17; A47L 23/00; A47L 23/04; A47L 23/10; A47L 23/12; Y10T 428/24802; Y10T 428/2481; D06N 7/0092

USPC ..... 15/104.93, 118, 208, 209.1, 223, 224, 15/229.11; 428/195.1, 196

See application file for complete search history.

(56) References Cited

U.S. PATENT DOCUMENTS

| | | | | |
|---|---|---|---|---|
| 1,940,728 | A * | 12/1933 | O'Connor | A47L 23/10 401/7 |
| 5,085,914 | A * | 2/1992 | Perdelwitz, Jr. | A47L 13/16 428/137 |
| 2003/0124935 | A1* | 7/2003 | Smith | F41H 5/0492 442/239 |
| 2003/0228813 | A1* | 12/2003 | Johnson | D04H 1/49 442/101 |
| 2005/0260390 | A1* | 11/2005 | Croft | A61K 8/0208 428/196 |
| 2007/0271719 | A1* | 11/2007 | Schindler | B24D 11/00 15/209.1 |
| 2013/0101805 | A1* | 4/2013 | Altshuler | B32B 5/245 428/172 |
| 2014/0317862 | A1* | 10/2014 | Yuan | A45D 34/04 15/104.93 |
| 2015/0040940 | A1* | 2/2015 | Krasniansky | B08B 1/006 134/6 |
| 2016/0367103 | A1* | 12/2016 | Daveloose | A47L 13/17 |
| 2018/0206692 | A1* | 7/2018 | Cira | D04H 1/4258 |

FOREIGN PATENT DOCUMENTS

| | | | |
|---|---|---|---|
| GB | 1348526 | * | 3/1974 |
| WO | 2004/020725 | * | 3/2004 |

* cited by examiner

*Primary Examiner* — Mark Spisich

(57) ABSTRACT

A portable shoe surface cleaning cloth includes a cloth and four rubbing structure areas. The cloth is soaked or coated with cleaning solution. The four rubbing structure areas are first, second, third, and fourth rubbing structure areas and are located on the bottom surface of cloth side by side. The rubbing structure areas are provided with a plurality of prominent structures.

2 Claims, 1 Drawing Sheet

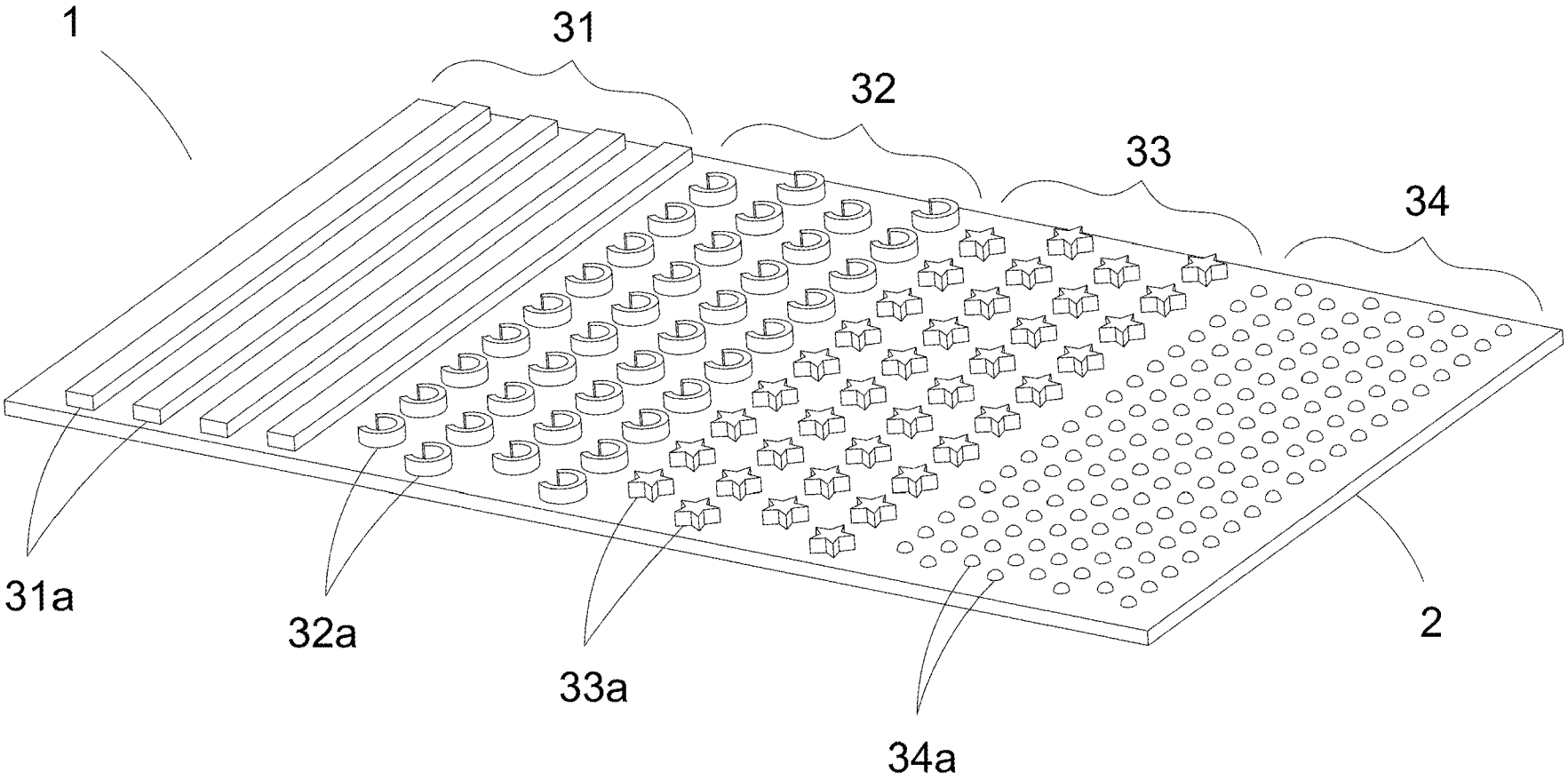
34
33
32
31
1
2
34a
33a
32a
31a

PORTABLE SHOE SURFACE CLEANING CLOTH

BACKGROUND OF THE INVENTION

1. Field of the Invention

The invention relates to cleaning cloths and more particularly to a portable shoe surface cleaning cloth having improved characteristics.

2. Description of Related Art

In daily life, when people are walking, jogging or exercising, the shoe surface is stained with dust, blot, dirt or mud more or less, and the fine particles in the atmospheric haze are likely to adhere to the surface of shoes, without instant cleaning and after a long-term accumulation, the shoe leather brightness cannot be maintained, and it is difficult to clean the shoe surface.

Thus, the need for improvement still exists.

SUMMARY OF THE INVENTION

It is therefore one object of the invention to provide a portable shoe surface cleaning cloth comprising a cloth; and at least one rubbing structure area; wherein the rubbing structure area is located on any side or both sides of the cloth; the cloth is soaked or coated with cleaning solution; the rubbing structure area is provided with a plurality of prominent structures; and the prominent structure is a prominent structure with text, lines, patterns or geometric patterns.

The above and other objects, features and advantages of the invention will become apparent from the following detailed description taken with the accompanying drawings.

BRIEF DESCRIPTION OF THE DRAWINGS

FIG. 1 is a perspective view of a portable shoe surface cleaning cloth according to the invention.

DETAILED DESCRIPTION OF THE INVENTION

Referring to FIG. 1, a portable shoe surface cleaning cloth 1 in accordance with the invention comprises a cloth 2 and four rubbing structure areas. The cloth 2 is soaked or coated with cleaning solution. The rubbing structure areas include a first rubbing structure area 31, a second rubbing structure area 32, a third rubbing structure area 33 and a fourth rubbing structure area 34, which are located on the bottom surface of the cloth 2 side by side. The rubbing structure areas are provided with a plurality of prominent structures.

The rubbing structure area can be located on any side or both sides of the cloth 2. The prominent structure of the rubbing structure area can be prominent structure of text, lines, patterns or geometric patterns. The cloth 2 is nonwoven fabric. The prominent structure is silica gel structure.

The first rubbing structure area 31 is provided with a plurality of strip-shaped prominent structures 31*a*. With the rubbing action on the shoe surface and the infiltration of cleaning solution in the wiping process, the three-dimensional rough structure formed of the strip-shaped prominent structures 31*a* laterally pushes and scrapes the extensive stain, mud or dust off the shoe surface.

The second rubbing structure area 32 is provided with a plurality of "ɔ" shaped prominent structures 32*a*. With the rubbing action on the shoe surface and the infiltration of cleaning solution in the wiping process, the residual massive stain, mud or dust on the shoe surface is covered and removed completely by the covering characteristic with split ring structure of the "ɔ" shaped prominent structures 32*a*.

The third rubbing structure area 33 is provided with a plurality of "☆" shaped prominent structures 33*a*. With the rubbing action on the shoe surface and the infiltration of cleaning solution in the wiping process, the fine dust or dirt on the shoe surface is removed by the sharp corners spreading in different directions of the "☆" shaped prominent structures 33*a*.

The fourth rubbing structure area 34 is provided with a plurality of hemispherical prominent structures 34*a*. With the rubbing action on the shoe surface and the infiltration of cleaning solution in the wiping process, the three-dimensional spheres of the hemispherical prominent structures 34*a* rub and polish the leather or fabric of the clean shoe surface dottily.

While the invention has been described in terms of preferred embodiments, those skilled in the art will recognize that the invention can be practiced with modifications within the spirit and scope of the appended claims.

What is claimed is:

1. A portable shoe surface cleaning cloth comprising:

a cloth having opposed top and bottom sides; and at least one rubbing structure area;

wherein the at least one rubbing structure area is located on any side or both sides of the cloth; the cloth is soaked or coated with a cleaning solution; the at least one rubbing structure area is provided with a plurality of prominent structures; and each of the prominent structures is a prominent structure with text, lines, patterns or geometric patterns;

wherein the at least one rubbing structure area includes first, second, third, and fourth rubbing structure areas located on the bottom side of the cloth side by side;

wherein the first rubbing structure area is provided with a plurality of strip-shaped prominent structures; and with rubbing on a shoe surface and infiltration of the cleaning solution in a wiping action, a three-dimensional rough structure formed of the strip-shaped prominent structures laterally pushes and scrapes stain, mud or dust off the shoe surface;

wherein the second rubbing structure area is provided with a plurality of "ɔ" shaped prominent structures; and with the rubbing on the shoe surface and the infiltration of the cleaning solution in the wiping action, the stain, the mud or the dust on the shoe surface is covered and removed completely by a covering characteristic with a split ring structure of the "ɔ" shaped prominent structures;

wherein the third rubbing structure area is provided with a plurality of "☆" shaped prominent structures; and with the rubbing on the shoe surface and the infiltration of the cleaning solution in the wiping action, the dust on the shoe surface is removed by a plurality of sharp corners spreading in different directions of the "☆" shaped prominent structures; and wherein the fourth rubbing structure area is provided with a plurality of hemispherical prominent structures; and with the rubbing on the shoe surface and the infiltration of the cleaning solution in the wiping action, a plurality of three-dimensional spheres of the hemispherical prominent structures rub and polish the shoe surface.

2. The portable shoe surface cleaning cloth of claim 1, wherein the cloth is nonwoven fabric; and each prominent structure is a silica gel structure.

* * * * *